US007696940B1

(12) United States Patent
MacDonald

(10) Patent No.: US 7,696,940 B1
(45) Date of Patent: Apr. 13, 2010

(54) WIRELESS NETWORKING ADAPTER AND VARIABLE BEAM WIDTH ANTENNA

(75) Inventor: Curtis MacDonald, Bethlehem, PA (US)

(73) Assignee: HField Technologies, Inc., Bethlehem, PA (US)

( * ) Notice: Subject to any disclaimer, the term of this patent is extended or adjusted under 35 U.S.C. 154(b) by 907 days.

(21) Appl. No.: 11/381,686

(22) Filed: May 4, 2006

Related U.S. Application Data

(60) Provisional application No. 60/677,095, filed on May 4, 2005.

(51) Int. Cl.
*H01Q 3/12* (2006.01)

(52) U.S. Cl. ..... 343/724; 343/761; 343/833; 343/834; 343/839

(58) Field of Classification Search ..... 343/795, 343/819–822, 833, 834, 839, 724, 761; 455/575.7
See application file for complete search history.

(56) References Cited

U.S. PATENT DOCUMENTS

| | | | | |
|---|---|---|---|---|
| 2,473,421 | A | 6/1949 | Fubini et al. | |
| 4,631,546 | A | 12/1986 | Dumas et al. | |
| 5,231,413 | A | 7/1993 | Dubois | |
| 5,617,102 | A | 4/1997 | Prater | |
| 6,034,638 | A | 3/2000 | Theil et al. | |
| 6,049,310 | A * | 4/2000 | Sadahiro | 343/702 |
| 6,154,177 | A | 11/2000 | Saito et al. | |
| 6,208,300 | B1 | 3/2001 | Johnson | |
| 6,307,524 | B1 * | 10/2001 | Britain | 343/795 |
| 6,370,369 | B1 | 4/2002 | Kraiem et al. | |
| 6,753,826 | B2 * | 6/2004 | Chiang et al. | 343/834 |
| 6,873,293 | B2 | 3/2005 | Proctor, Jr. et al. | |
| 6,876,337 | B2 | 4/2005 | Larry | |
| 6,944,433 | B2 | 9/2005 | Ogino | |
| 6,954,180 | B1 | 10/2005 | Braun et al. | |
| 7,436,829 | B2 * | 10/2008 | Chen et al. | 370/389 |
| 2002/0113743 | A1 | 8/2002 | Judd et al. | |
| 2003/0210201 | A1 | 11/2003 | Noguchi et al. | |
| 2005/0190115 | A1 | 9/2005 | Chiang et al. | |

* cited by examiner

*Primary Examiner*—Michael C Wimer
(74) *Attorney, Agent, or Firm*—Design IP

(57) ABSTRACT

A wireless networking adapter that incorporates a Yagi-style directional antenna preferably includes at least one driver element positioned between a reflector element and at least two director elements. Another embodiment of the invention comprises a wireless access point having Yagi-style antenna that includes a driver that is adapted to rotate between a first position, in which the driver is in phase with the reflector an at least two directors, and a second position, in which the driver out of phase with a reflector and at least two directors.

7 Claims, 9 Drawing Sheets

WIRELESS NETWORKING ADAPTER AND VARIABLE BEAM WIDTH ANTENNA

CROSS-REFERENCE TO RELATED APPLICATION

This application claims the benefit of U.S. Provisional Application No. 60/677,095, filed on May 4, 2005, which is hereby incorporated by reference as if fully set forth herein.

BACKGROUND OF THE INVENTION

This invention relates to a wireless device for use in a local area network (LAN).

Most current wireless networking adapters use an omni-directional antenna, which has a maximum operating range of 300 feet. In many operating environments, it is desirable to have a greater operating range.

There have been some attempts to use directional antennas with wireless networking adapters. Some use an auxiliary antenna that is used as add-on to an existing wireless networking adapter. Such devices are undesirable because they are bulky, difficult to aim, and result in only negligible improvements in operating range.

There have been some attempts to provide a wireless networking adapter with an integrated directional antenna. Many of these devices use large directional antennas, such as a parabolic antenna, and therefore, are inconvenient to use—especially for laptop users. Those that use smaller directional antennas, such as a micro-strip patch, provide little improvement in operating range.

SUMMARY OF THE INVENTION

In one aspect, the invention comprises a wireless networking adapter including a directional antenna that is adapted to send and receive wireless signals of a first protocol (preferably 2.4 Ghz WiFi). The directional antenna preferably includes at least one driver element positioned between a reflector element and at least two director elements. The adapter also includes a decoder circuit that translates wireless signals received through the directional antenna from the first protocol to a second protocol and transmits signals in accordance with the second protocol via a first connector and receives wireless signals through the first connector from the second protocol to the first protocol and transmits signals in accordance with the first protocol via the directional antenna. The first connector is electrically connected to a computer, transmits signals to the computer and receives signals from the computers electrical, the signals being in accordance with the second protocol.

In another aspect, the invention comprises a wireless access point including a directional antenna including a driver, a reflector and at least two directors. In accordance with the invention, the driver is adapted to rotate between a first position, in which the driver is in phase with the reflector an at least two directors, and a second position, in which the driver is out of phase with the reflector and the directors.

DETAILED DESCRIPTION OF THE PREFERRED EMBODIMENT(S)

Figure 1:
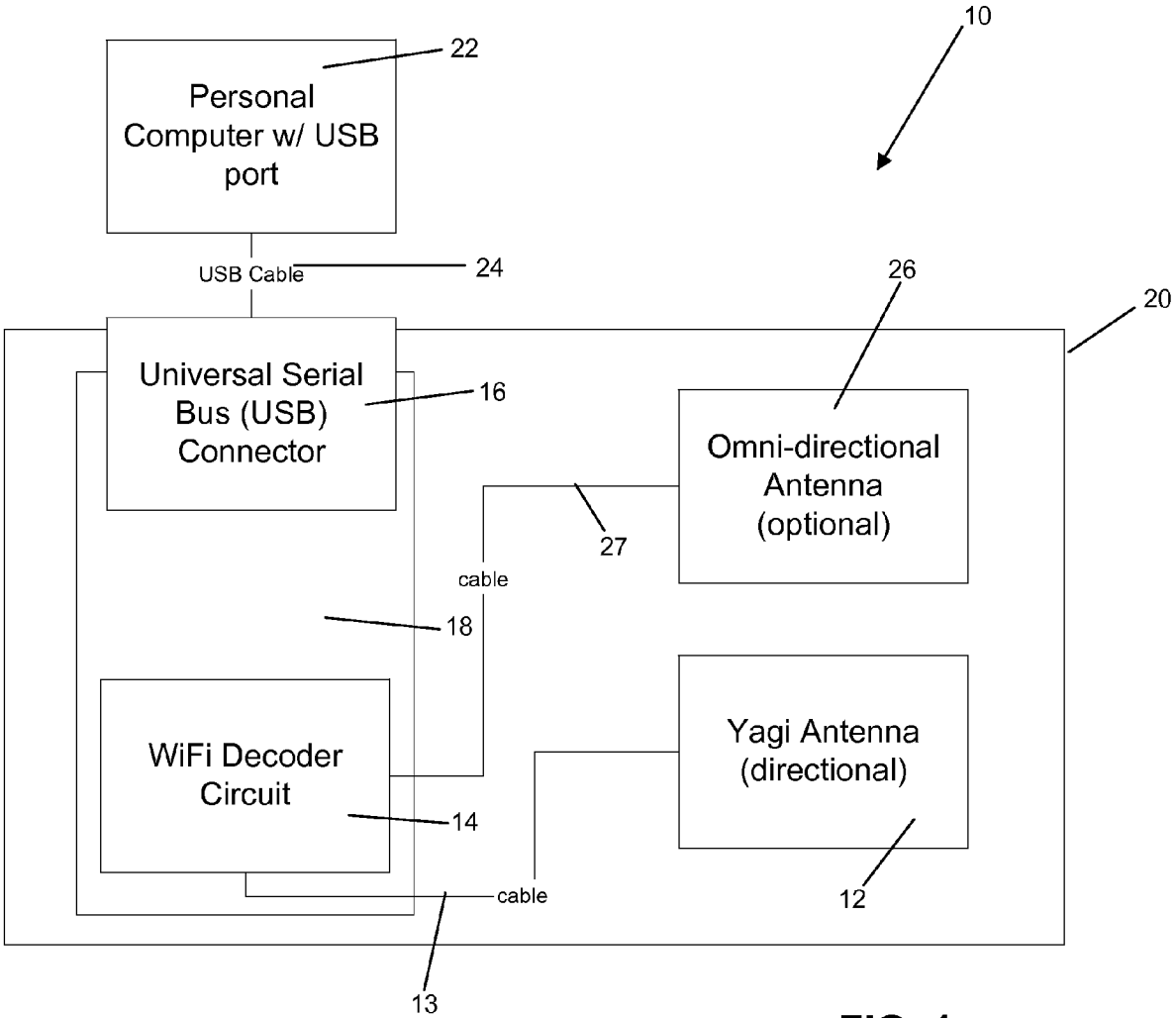
FIG. 1 is a block diagram showing a preferred embodiment of the wireless networking adapter of the present invention.

The following detailed description of the preferred embodiments of the invention will be better understood when read in conjunction with the appended drawings. For the purposes of illustrating the invention, there is shown in the drawings embodiments which are presently preferred. It is understood, however, the invention is not limited to the precise arrangements and instrumentalities shown in the drawings.

To aid in describing the invention, directional terms are used in the specification and claims to describe portions of the present invention (e.g., front, rear, left, right, top and bottom, etc.). These directional definitions are intended to merely assist in describing and claiming the invention and are not intended to limit the invention in any way. In addition, reference numerals that are introduced in the specification in association with a drawing figure may be repeated in one or more subsequent figures without additional description in the specification in order to provide context for other features.

Referring now to FIG. 1, reference numeral 10 generally refers to a wireless networking adapter in accordance with the present invention. This embodiment of the wireless networking adapter 10 includes a directional antenna 12, a decoder circuit 14, a connector 16, for connecting the adapter 10 to a personal computer 22, and a protective case 20. The adapter 10 may optionally also include an omni-directional antenna 26. The decoder circuit 14 and the connector 16 are preferably mounted to a printed circuit board 18.

The directional antenna 12 is preferably a Yagi antenna which will be described in greater detail herein. In this embodiment, the directional antenna 12 is intended to send and receive "WiFi" wireless signals, which are wireless signals configured in accordance with the IEEE 802.11b or 802.11g standard. The adapter 10 communicates with the personal computer 22 preferably using a universal serial bus (USB) standard. The decoder circuit 14 converts WiFi signals received from the directional antenna 12 through a cable 13 to USB format and vice-versa for signals received from the personal computer 22 through the connector 16. Any suitable decoder circuit 14 can be used, such as a ZyDAS model ZD1202 signal conversion chip, for example. The cable 13 connecting the directional antenna 12 to the decoder circuit 14 is preferably a u.fl miniature coaxial cable. The connector 16 is preferably a USB connector which could be inserted directly into a USB port of the personal computer 22 or connected using a USB cable 24.

Figure 2:
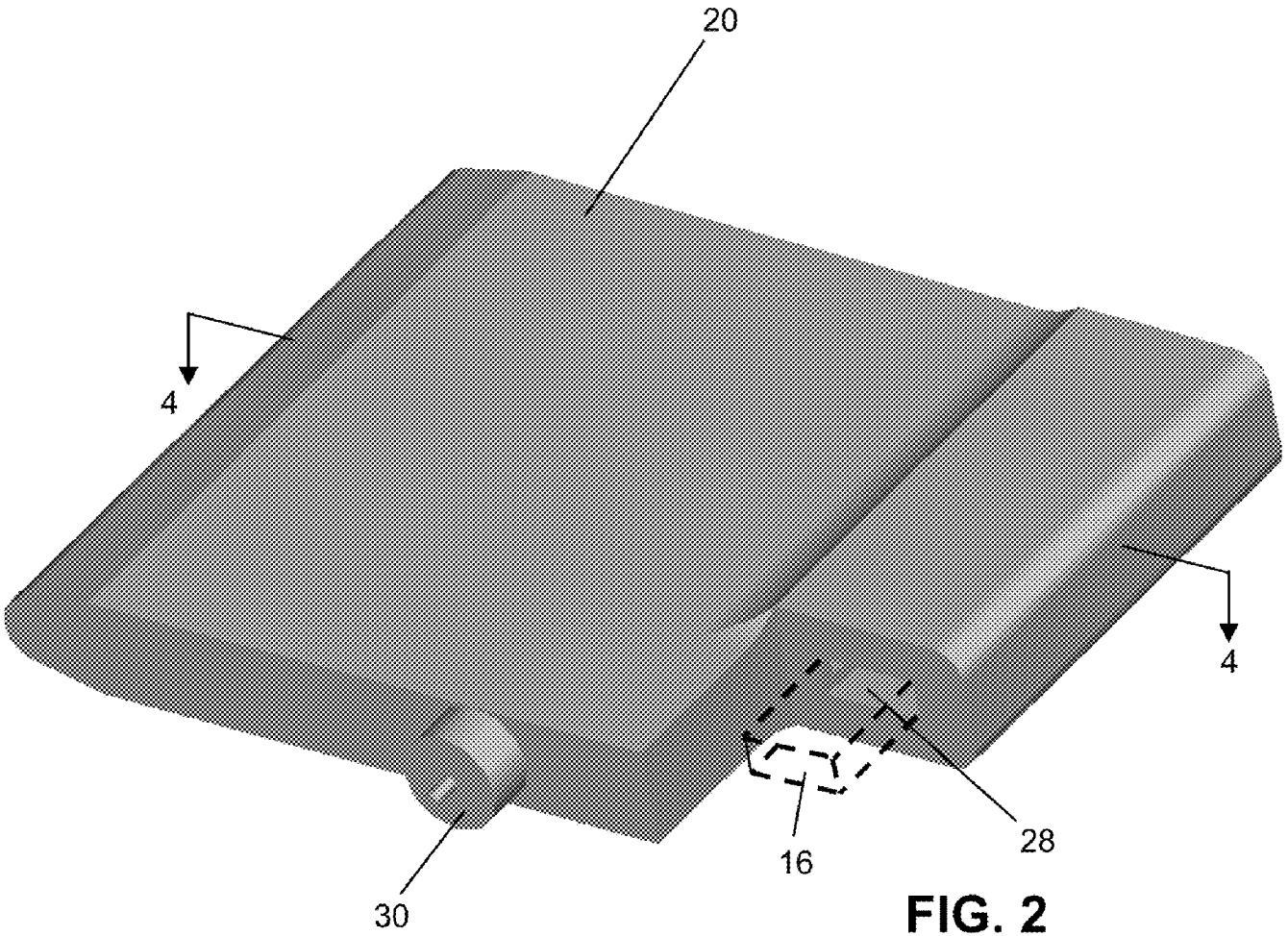
FIG. 2 is a perspective view of the wireless networking adapter, viewed from the bottom and rear.
Figure 3:
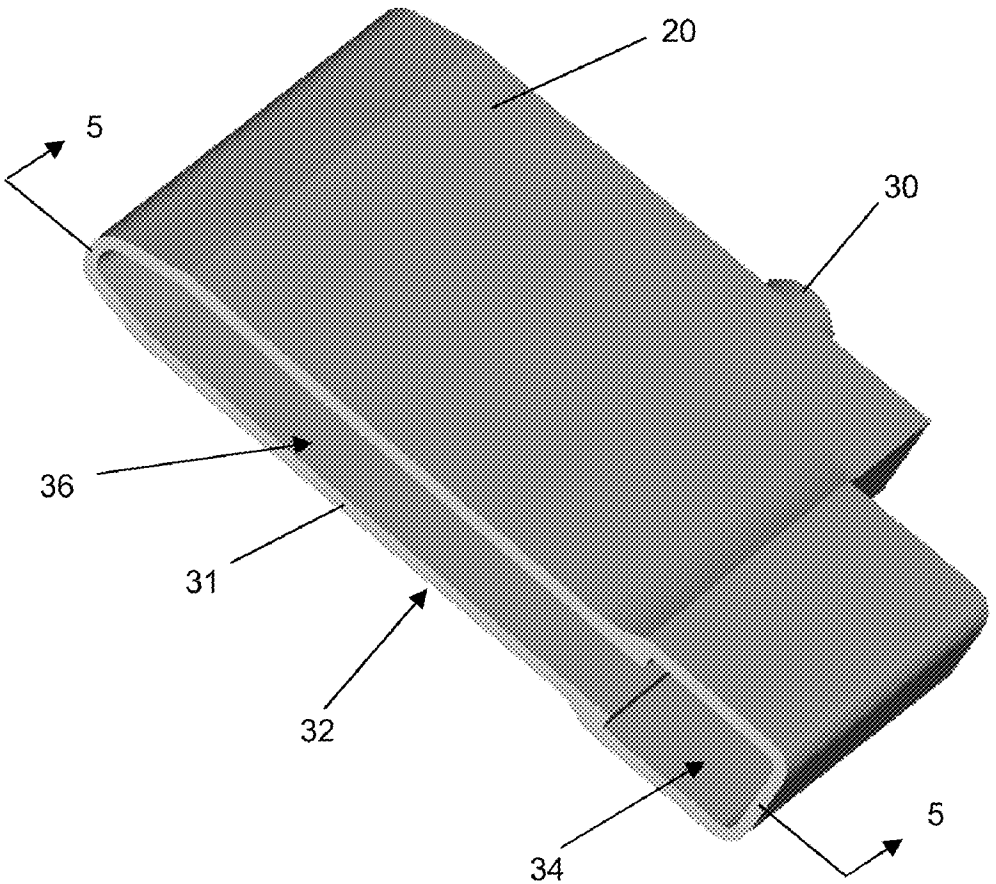
FIG. 3 is a perspective view of the wireless networking adapter viewed from the top and rear, with the end cap removed.

The case 20 is designed to retain and protect the components of the wireless networking adapter 10, as well as to minimize detrimental interference to the performance of the directional antenna 12. Referring now to FIGS. 2 and 3, the general shape and configuration of the case 20 as shown. It should be noted that many other possible shapes and configurations for the case 20 could be provided. In this embodiment, the case 20 includes a mount 30, which when attached to a base or retaining clip (not shown), enables the case to be positioned in a manner that maximizes signal strength. The case is preferably formed of a polymeric material, such as ABS plastic, for reasons of economy of manufacture, low resistance to wave penetration and durability.

As is visible in FIG. 2, the USB connector 16 protrudes through an opening 28 located on the bottom right side of the case 20. Referring to FIG. 3, the case 20 preferably includes two chambers, a chamber 34 which houses a decoder circuit 14 and a chamber 36 which houses the directional antenna 12. The top end 32 of the case is preferably open, to enable easy insertion of the wireless networking adapter 10 components, including the directional antenna 12 and the decoder 14. The top end 32 is preferably capped with a solid cap (not shown) after installation of the directional antenna 12 and the decoder circuit 14.

Figure 4:
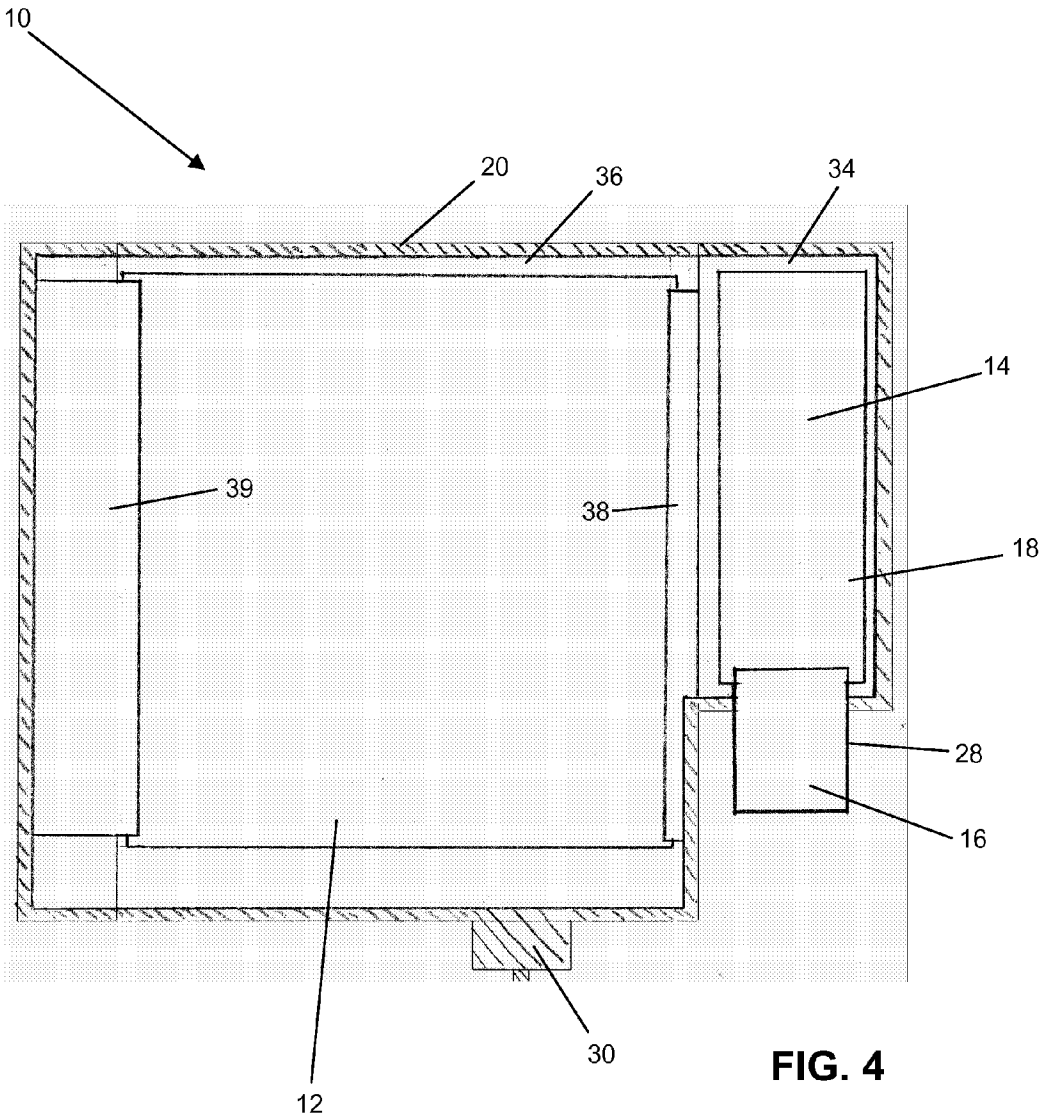
FIG. 4 is a sectional view taken along lines 4-4 of FIG. 2.
Figure 5:
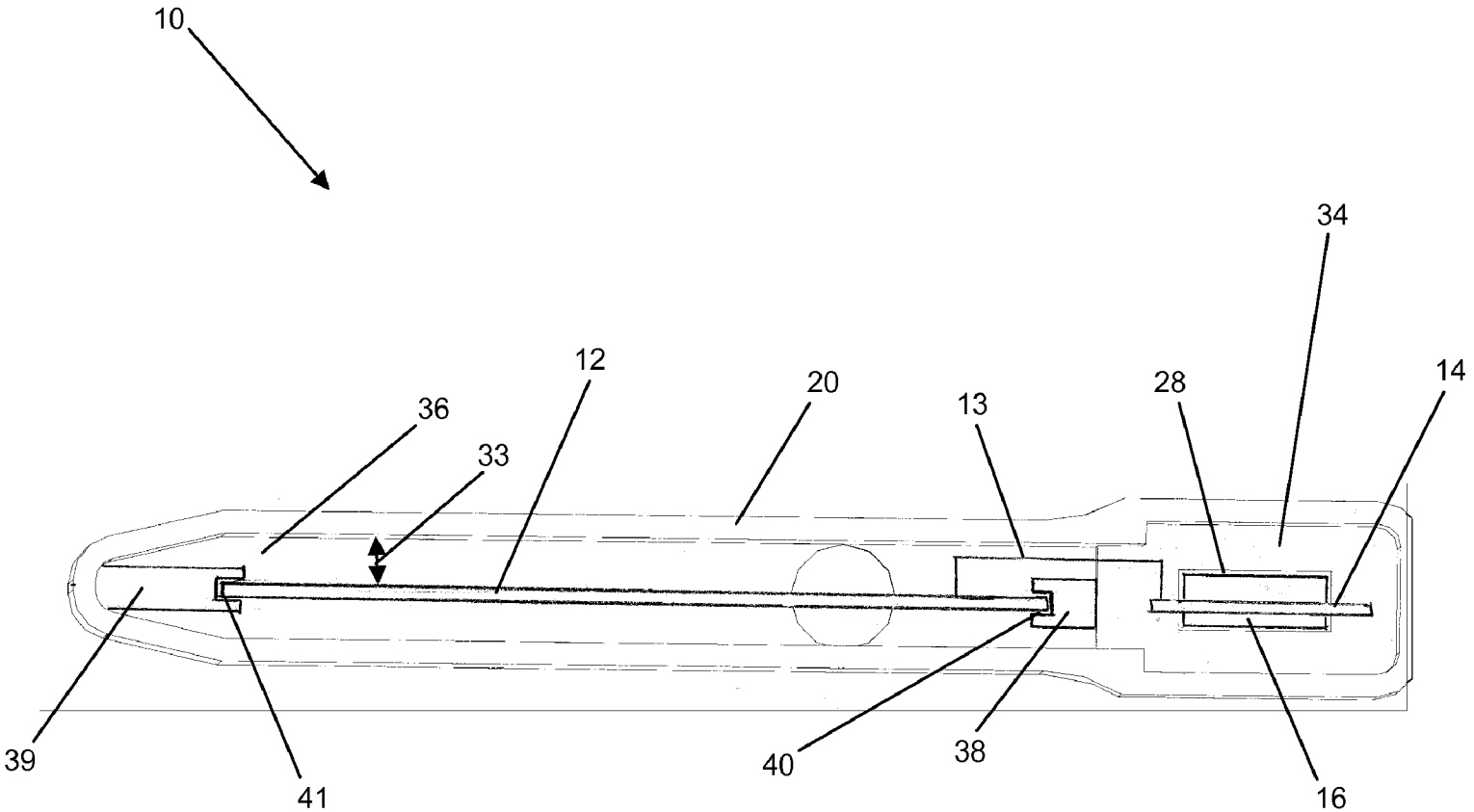
FIG. 5 is a sectional view taken along lines 5-5 of FIG. 3.

Referring now to FIGS. 4 and 5, the chambers 34, 36 are each preferable sized and configured to accommodate the physical requirements of the decoder circuit 14 and the directional antenna 12, respectively, while minimizing the overall size of the case 20. Retaining members 38, 39 are provided to retain the directional antenna 12 in the proper position inside the case 20. Each retaining member 38, 39 preferably includes an elongated slot 40, 41, which is intended to receive an edge of the directional antenna 12. Preferably the retaining slots 40, 41 are sized and configured to provide a friction fit, so that the directional antenna 12 does not move once installed.

Figure 6:
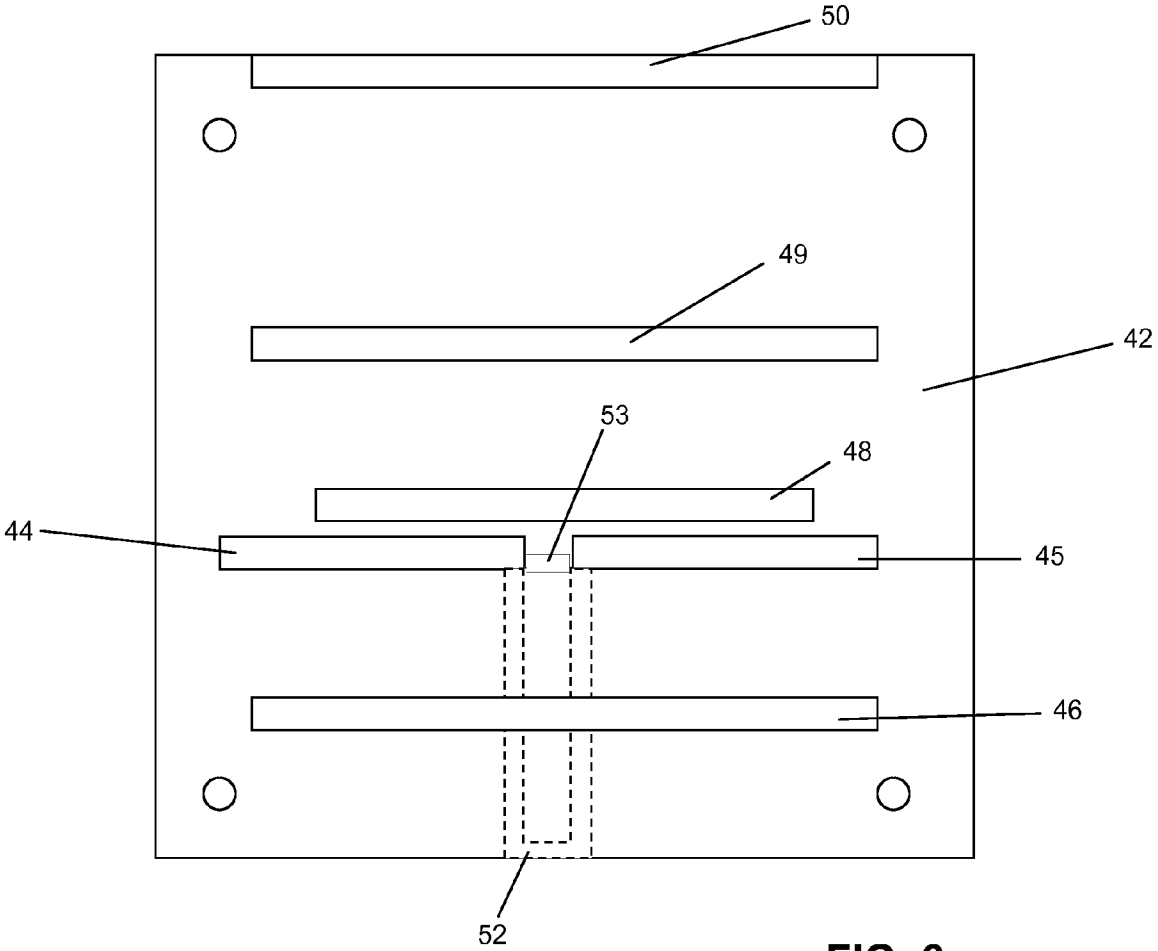
FIG. 6 is a top view of the directional antenna used in the wireless networking adapter.

Referring now to FIG. 6, the directional antenna 12 will be described in greater detail. As is conventional with Yagi antennas, the directional antenna 12 preferably includes a driver 44 (in this embodiment, two drivers 44, 45 are provided), a reflector 46 and three directors 48, 49, 50. The driver 44, reflector 46 and directors 48, 49, 50 are all comprised of thin copper strips mounted on a printed circuit board 42. Alternatively, the directional antenna 12, decoder circuit 14 and the connector 16 could all be incorporated into the same printed circuit board 18 (see FIG. 1).

This configuration provides excellent signal strength performance in a very thin and compact manner. Each driver 44,45 is electrically connected to the coaxial cable 13 through a connector 52, which is located on the rear of the printed circuit board 42.

When receiving a wireless signal, the directors 48, 49, 50 focus the signal on the drivers 44,45. The reflector 46 creates a standing wave between the drivers 44,45 and reflector 46 which further increases signal strength. The signal excites the drivers 44,45, which generates an electrical current. Director 48 is optional and, in addition to focusing the signal on the drivers 44,45 broadens the band width of signals received by the drivers 44,45. This provides improved reception reliability for the drivers across the full WiFi signal band width.

The size and configuration of the drivers 44,45 reflector 46 and directors 48, 49, 50 will depend, among other factors, upon the signal characteristics of the decoder circuit 14 and the cable 13, as well as the physical characteristics of the case 20, and the intended operating environment. In order to maximize operating range, the directional antenna must be properly tuned and impedance must be balanced. Proper tuning is particularly difficult when working with high-frequency signal transmission, such as those in the 2.4 Ghz frequency range of WiFi signals.

The precise configuration for the directional antenna 12 when used combination with the case 20, as shown in FIGS. 2-3, has not been determined as of the filing date of this application. In an earlier prototype of the invention, the following configuration for the drivers 44,45, reflector 46 and directors 48, 49, 50 was found to work well with a case formed of ABS plastic and having a clearance of approximately 1.5 cm above and below the directional antenna 12:

TABLE 1

(all units in inches)

| Element | Width | Length | Location (relative to reflector 46) |
|---|---|---|---|
| driver 44 | 0.10 | 1.15 | 0.66 |
| driver 45 | 0.10 | 1.15 | 0.66 |
| reflector 46 | 0.10 | 2.12 | n/a |
| director 48 | 0.12 | 1.64 | 0.83 |
| director 49 | 0.10 | 1.88 | 1.28 |
| director 50 | 0.10 | 1.84 | 2.14 |

All elements are preferably centered (left-to-right) on the printed circuit board 42, except the drivers 44, 45 which are centered on the printed circuit board 42 with a 0.10 inch space 53 between them. This results in an overall width of 2.40 inches for both drivers 44, 45, including the space.

Arriving at this configuration for the directional antenna 12 required a unique approach to its design and manufacturing and involved the design and testing of many unsuccessful prototypes. It is expected that the preferred configuration of the directional antenna 12 will be slightly different for case 20 (as opposed to the case of the earlier prototype), due to the fact that the case 20 preferably has less clearance above and below the directional antenna 12 than the case of the earlier prototype.

Impedance balancing was also particularly challenging in this application. In order to properly balance impedance, an in-line capacitor (not shown) was attached to the printed circuit board 42 between the cable 13 and the connector 52.

Under both laboratory and field conditions, this embodiment of the directional antenna 12 provides a very forgiving beam width, a 10 dBi signal gain and an operating range of at least 1000 feet. Therefore, the present invention provides an operating range that provides excellent range and usability in a very small form factor.

Figure 7:
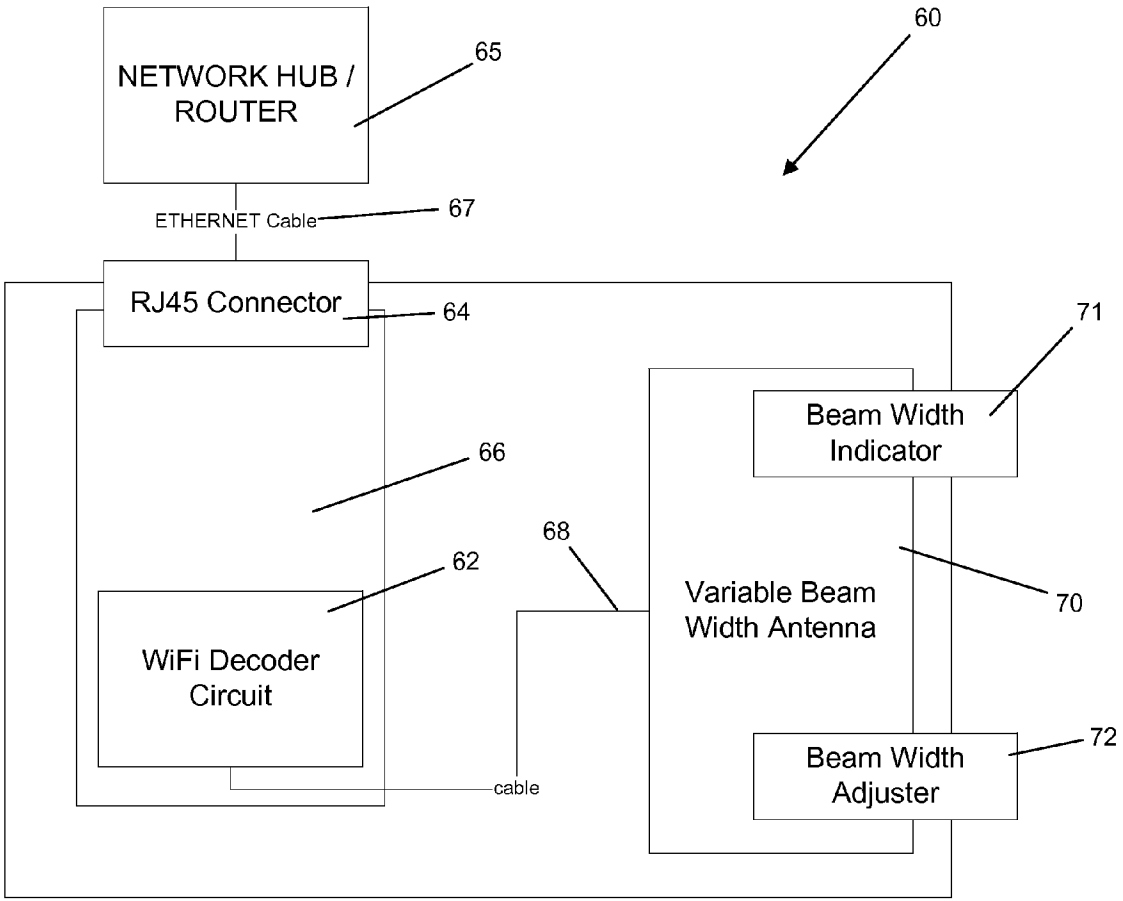
FIG. 7 is a block diagram showing a wireless access point which incorporates a variable beam width antenna.

Referring now to FIG. 7, reference numeral 60 refers generally to wireless access point, which represents another aspect to the present invention. The wireless access point 60 is conventional in configuration and function, except that it includes a variable beam width antenna 70. As is conventional, the wireless access point 60 includes a decoder circuit 62, which converts incoming WiFi signals into Ethernet (IEEE 802.3) signals. These signals are transmitted to other LAN components, such as a network hub or router 65 through a standard RJ45 connector 64 using a conventional Ethernet cable 67. The connector 64 and decoder circuit 62 are preferably mounted to a printed circuit board 66. The variable beam width antenna 70 could be mounted to the same printed circuit board 66 or be mounted on a separate printed circuit board.

The variable beam width antenna 70 is preferably connected to the decoder circuit 62 using a coaxial cable 68 having a male coaxial connector (not shown). The variable beam width antenna 70 includes a beam width adjustor 72 and preferably a beam width indicator 71.

Figure 9:
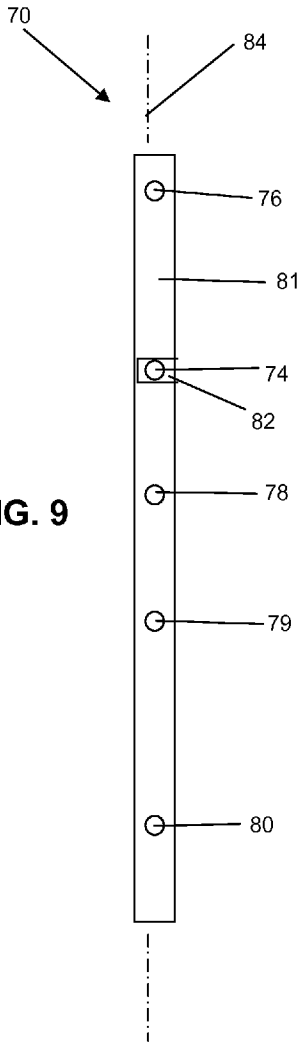
FIG. 9 is a right side view of the variable beam width antenna shown in FIG. 8, with the driver in a directional configuration.
Figure 8:
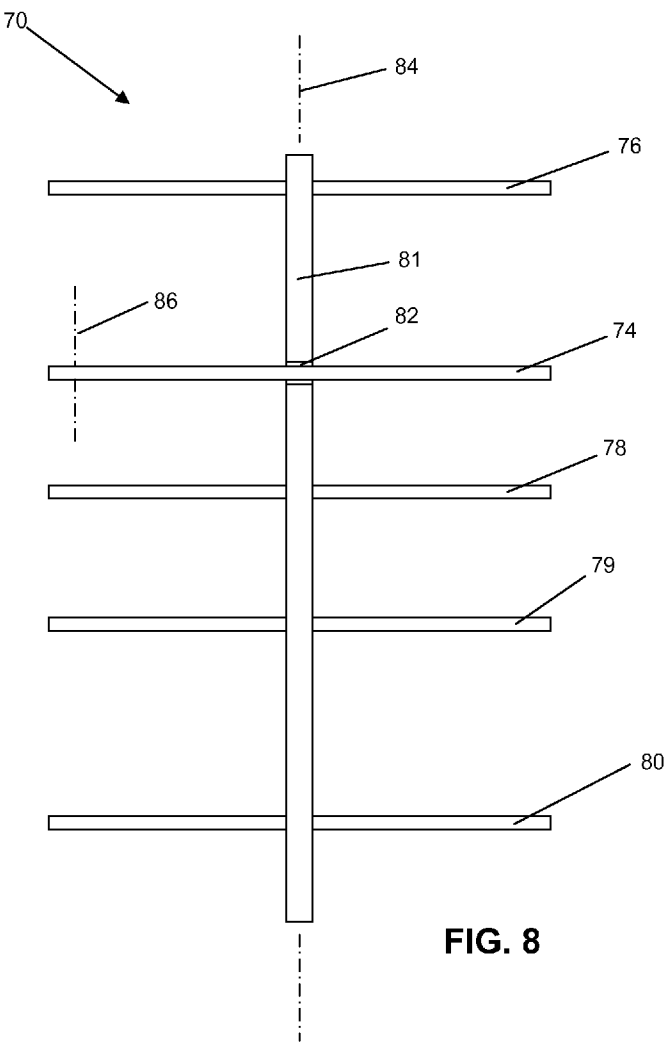
FIG. 8 is a top view of one embodiment of the variable beam width antenna of the present invention.
Figure 10:
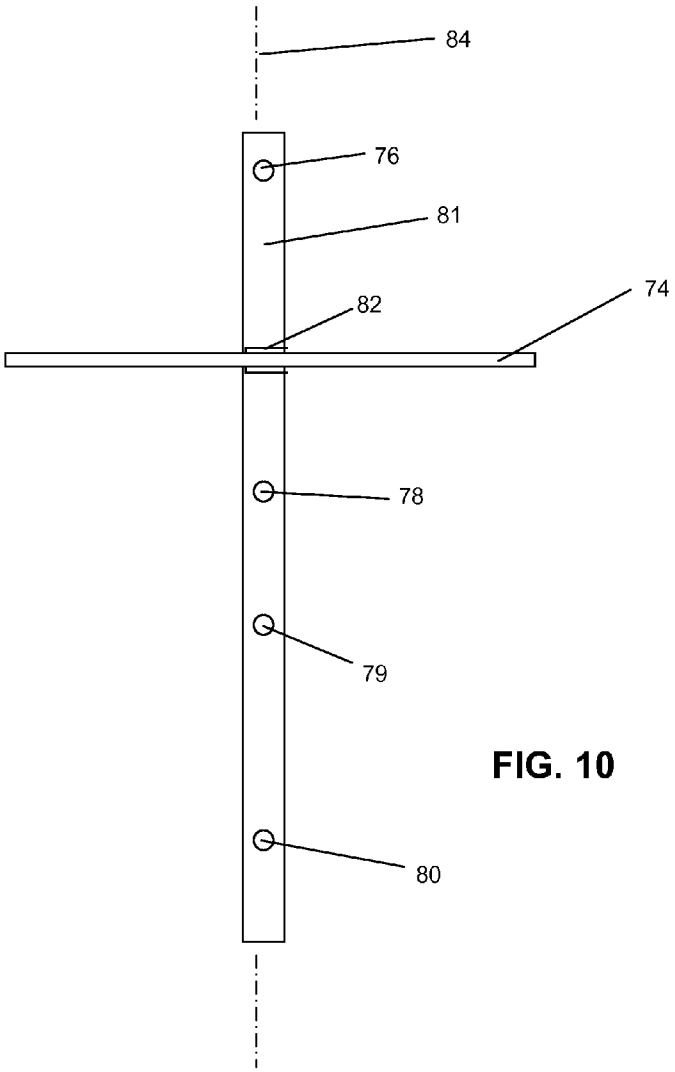
FIG. 10 is a right side view of the variable beam width antenna shown in FIG. 8, with the driver in an omni-directional configuration.

A preferred embodiment of the variable beam width antenna 70 is shown in FIGS. 8-10. The antenna 70 is preferably a Yagi-style antenna which includes a driver 74, a reflector 76, and directors 78, 79, 80. These components are preferably cylindrical in shape, are formed of copper wire and are retained in position by a shell 81. Alternatively, the reflector 76, director 78, 79, 80 could be embedded on a printed circuit board (not shown) that would allow for axial movement of the driver 74.

In accordance with the present invention, the shell 81 preferably includes a slot 82, which allows for axial movement of the driver 74. Preferably, the driver 74 is pivoted about an axis 86 which is offset from the central axis 84 of the shell 81. The driver 74 preferably has a range of motion of at least approximately 90° which extends from a position in which the driver 74 is coplanar with the reflector 76 and directors 78, 79, 80 (as shown in FIGS. 8 and 9) to a position in which the driver is perpendicular to the reflector 76 and directors 78, 79, 80.

When the driver 74 is in the coplanar position (as shown in FIGS. 8-9), the antenna 70 functions as a directional antenna (minimum beam width). Conversely, when the driver 74 is in a perpendicular position (as shown in FIG. 10), the antenna 70 functions as an omni-directional antenna (maximum beam width). The beam width of the antenna 70 can be varied by moving the driver 74 between the coplanar and perpendicular positions. Preferably and adjustment device, such as a knob, dial or lever (not shown) is provided to enable precise rotation of the driver 74. In addition, the beam width indicator 71 is provided to show the relative beam width of the antenna 70 and is preferably calibrated to reflect the position of the driver 74.

Other configurations of the antenna 70 are possible, provided that means are included which enable the driver 74 (or multiple drivers) to be positioned in phase with the reflector 76 and directors 78, 79, 80 and pivoted or otherwise moved to a position in which the driver 74 is out of phase with the reflector 76 and directors 78, 79, 80.

While the principals of the invention have been described in connection with the preferred embodiments, it is to be clearly understood that this description is made only by way of example and not as a limitation of the scope of the invention.

The invention claimed is:

1. A wireless access point comprising:

a decoder circuit; and an antenna comprising a driver, a reflector and at least one director, the driver being adapted to move between a first position, in which the driver is in phase with the reflector and the at least one director, and a second position, in which the driver is out of phase with the reflector and the at least one director.

2. The wireless access point of claim 1, wherein the antenna functions as a directional antenna when the driver is oriented in the first position and functions as an omni-directional antenna when the driver is oriented in the second position.

3. The wireless access point of claim 1, wherein the driver is adapted to rotate from the first position to the second position.

4. The wireless access point of claim 3, wherein the first position is orthogonal to the second position.

5. The wireless access point of claim 1, wherein the antenna has a central axis that bisects the reflector and at least one director and the driver rotates about a first axis that is offset from the central axis.

6. The wireless access point of claim 5, wherein the first axis is parallel to the central axis.

7. The wireless access point of claim 1, wherein the at least one director comprises at least two directors.

* * * * *